US006513334B2

(12) United States Patent
Varney

(10) Patent No.: US 6,513,334 B2
(45) Date of Patent: Feb. 4, 2003

(54) COMBUSTION CHAMBER

(75) Inventor: Brian A. Varney, Coventry (GB)

(73) Assignee: Rolls-Royce plc, London (GB)

( * ) Notice: Subject to any disclaimer, the term of this patent is extended or adjusted under 35 U.S.C. 154(b) by 40 days.

(21) Appl. No.: 09/911,809

(22) Filed: Jul. 25, 2001

(65) Prior Publication Data

US 2002/0020173 A1 Feb. 21, 2002

(30) Foreign Application Priority Data

Aug. 10, 2000 (GB) ..... 0019533

(51) Int. Cl.[7] ..... F02C 7/228; F02C 9/28

(52) U.S. Cl. ..... 60/776; 60/725; 60/747; 60/739

(58) Field of Search ..... 60/725, 737, 776, 60/746, 747, 748, 733, 739; 431/114

(56) References Cited

U.S. PATENT DOCUMENTS

| | | | | |
|---|---|---|---|---|
| 4,499,735 A | | 2/1985 | Moore | |
| 5,231,833 A | * | 8/1993 | MacLean et al. | 60/734 |
| 5,235,814 A | | 8/1993 | Leonard | |
| 5,319,935 A | * | 6/1994 | Toon et al. | 60/733 |
| 5,321,949 A | * | 6/1994 | Napoli et al. | 60/739 |
| 5,491,970 A | * | 2/1996 | Davis et al. | 60/776 |
| 5,628,192 A | * | 5/1997 | Hayes-Bradley et al. | 60/733 |
| 5,884,483 A | * | 3/1999 | Munro | 60/734 |
| 5,899,074 A | * | 5/1999 | Komatsu et al. | 60/737 |
| 5,924,275 A | * | 7/1999 | Cohen et al. | 60/778 |
| 6,052,986 A | | 4/2000 | Hoffmann | |
| 6,370,863 B2 | * | 4/2002 | Muller et al. | 60/776 |
| 6,418,725 B1 | * | 7/2002 | Maeda et al. | 60/776 |

FOREIGN PATENT DOCUMENTS

| | | |
|---|---|---|
| EP | 0687864 A2 A | 12/1995 |
| EP | 691511 A | 1/1996 |
| EP | 976982 A | 2/2000 |
| EP | 1108957 A | 6/2001 |
| WO | WO687864 A | 12/1995 |
| WO | WO35186 A | 8/1998 |

* cited by examiner

*Primary Examiner*—Ted Kim
(74) *Attorney, Agent, or Firm*—W. Warren Taltavull; Manelli Denison & Selter PLLC

(57) ABSTRACT

A three stage lean burn combustion chamber (28) comprises a primary combustion zone (36), a secondary combustion zone (40) and a tertiary combustion zone (44). Each of the combustion zones (36, 40, 44) is supplied with premixed fuel and air by respective fuel and air mixing ducts (76, 78, 80, 92). Secondary fuel injectors (106) and two secondary fuel manifolds (105A, 105B) supply fuel into different circumferential sectors, halves, of the secondary fuel and air mixing duct (80). The secondary fuel manifolds (105A, 105B) have secondary fuel valves (107A, 107B) which supply a greater proportion of fuel to the secondary fuel manifold (105A) than the secondary fuel manifold (105B) so that there is circumferential biasing of fuel in the secondary combustion zone (40). This circumferential biasing of fuel in the secondary combustion zone (40) reduces the generation of harmful pressure oscillations in the combustion chamber (28). Alternatively the biasing of the fuel may be in the primary or tertiary combustion zones (36, 44).

24 Claims, 4 Drawing Sheets

COMBUSTION CHAMBER

The present invention relates generally to a combustion chamber, particularly to a gas turbine engine combustion chamber.

In order to meet the emission level requirements, for industrial low emission gas turbine engines, staged combustion is required in order to minimise the quantity of the oxide of nitrogen (NOx) produced. Currently the emission level requirement is for less than 25 volumetric parts per million of NOx for an industrial gas turbine exhaust. The fundamental way to reduce emissions of nitrogen oxides is to reduce the combustion reaction temperature, and this requires premixing of the fuel and all the combustion air before combustion occurs. The oxides of nitrogen (NOx) are commonly reduced by a method which uses two stages of fuel injection. Our UK patent no. GB1489339 discloses two stages of fuel injection. Our International patent application no. WO92/07221 discloses two and three stages of fuel injection. In staged combustion, all the stages of combustion seek to provide lean combustion and hence the low combustion temperatures required to minimise NOx. The term lean combustion means combustion of fuel in air where the fuel to air ratio is low, i.e. less than the stoichiometric ratio. In order to achieve the required low emissions of NOx and CO it is essential to mix the fuel and air uniformly.

The industrial gas turbine engine disclosed in our International patent application no. WO92/07221 uses a plurality of tubular combustion chambers, whose axes are arranged in generally radial directions. The inlets of the tubular combustion chambers are at their radially outer ends, and transition ducts connect the outlets of the tubular combustion chambers with a row of nozzle guide vanes to discharge the hot gases axially into the turbine sections of the gas turbine engine. Each of the tubular combustion chambers has two coaxial radial flow swirlers which supply a mixture of fuel and air into a primary combustion zone. An annular secondary fuel and air mixing duct surrounds the primary combustion zone and supplies a mixture of fuel and air into a secondary combustion zone.

One problem associated with gas turbine engines is caused by pressure fluctuations in the air, or gas, flow through the gas turbine engine. Pressure fluctuations in the air, or gas, flow through the gas turbine engine may lead to severe damage, or failure, of components if the frequency of the pressure fluctuations coincides with the natural frequency of a vibration mode of one or more of the components. These pressure fluctuations may be amplified by the combustion process and under adverse conditions a resonant frequency may achieve sufficient amplitude to cause severe damage to the combustion chamber and the gas turbine engine.

It has been found that gas turbine engines which have lean combustion are particularly susceptible to this problem. Furthermore it has been found that as gas turbine engines which have lean combustion reduce emissions to lower levels by achieving more uniform mixing of the fuel and the air, the amplitude of the resonant frequency becomes greater.

The relationship between the pressure fluctuations and the combustion process may be coupled. It may be an initial unsteadiness in the combustion process which generates the pressure fluctuations. This pressure fluctuation then causes the combustion process, or heat release from the combustion process, to become unsteady which then generates more pressure fluctuations. This process may continue until high amplitude pressure fluctuations are produced.

Accordingly the present invention seeks to provide a combustion chamber which reduces or minimises the above mentioned problem.

Accordingly the present invention provides a combustion chamber comprising a plurality of combustion zones arranged in flow series defined by at least one peripheral wall, each combustion zone having at least one fuel and air mixing duct for supplying fuel and air into the respective one of the combustion zones, each of the fuel and air mixing ducts having at least one fuel injector for supplying fuel into the respective one of the fuel and air mixing ducts, the fuel injectors in the at least one fuel and air mixing duct for at least one of the combustion zones being arranged into a plurality of circumferentially arranged sectors, fuel supply means being arranged for supplying fuel to the fuel injectors, the fuel supply means being arranged for supplying a greater amount of fuel to one or more of the circumferentially arranged sectors than the remainder of the circumferentially arranged sectors to reduce the pressure oscillations in the combustion chamber.

The combustion chamber may comprise a primary combustion zone and a secondary combustion zone downstream of the primary combustion zone.

The combustion chamber may comprise a primary combustion zone, a secondary combustion zone downstream of the primary combustion zone and a tertiary combustion zone downstream of the secondary combustion zone.

Preferably the fuel injectors in the fuel and air mixing duct supplying fuel and air into the secondary combustion zone are arranged in circumferentially arranged sectors.

The fuel injectors in the fuel and air mixing duct supplying fuel and air into the tertiary combustion zone may be arranged in circumferentially arranged sectors.

The fuel injectors in the fuel and air mixing duct supplying fuel and air into the primary combustion zone may be arranged in circumferentially arranged sectors.

The at least one fuel and air mixing duct may comprise plurality of fuel and air mixing ducts.

Preferably there may be two circumferentially arranged sectors. Preferably the two circumferentially arranged sectors are halves or extend over 180°.

Alternatively there may be three circumferentially arranged sectors. The three circumferentially arranged sectors may be thirds or extend over 120°.

Alternatively there may be four circumferentially arranged sectors. The four circumferentially arranged sectors may be quarters or extend over 90°.

Alternatively there may be six circumferentially arranged sectors. The six circumferentially arranged sectors may be sixths or extend over 60°.

Alternatively there may eight circumferentially arranged sectors. The eight circumferentially arranged sectors may be eighths or extend over 45°.

Preferably the at least one fuel and air mixing duct comprises a single annular fuel and air mixing duct.

Preferably the fuel supply means comprises a plurality of fuel manifolds and a plurality of fuel valves, each fuel manifold supplying fuel to the fuel injectors in a respective of the circumferentially arranged sectors, each fuel valve controlling the supply of fuel to a respective one of the fuel manifolds.

Preferably transducer means are acoustically coupled to the combustion chamber to detect pressure oscillations in the combustion chamber.

Preferably the transducer means is arranged to send a signal indicative of the level of the pressure oscillations in the combustion chamber to a controller, the controller being arranged to send signals to the fuel valves for supplying a greater amount of fuel to one or more of the circumferentially arranged sectors than the remainder of the circumferentially arranged sectors to reduce the pressure oscillations in the combustion chamber when the pressure oscillations are above a predetermined level and for supplying equal amounts of fuel to all of the circumferentially arranged sectors to minimise emissions when the pressure oscillations are below the predetermined level.

The present invention also provides a method of operating a combustion chamber comprising a plurality of combustion zones arranged in flow series defined by at least one peripheral wall, each combustion zone having at least one fuel and air mixing duct for supplying fuel and air into the respective one of the combustion zones, each of the fuel and air mixing ducts having at least one fuel injector for supplying fuel into the respective one of the fuel and air mixing ducts, the fuel injectors in the at least one fuel and air mixing duct for at least one of the combustion zones being arranged into a plurality of circumferentially arranged sectors, fuel supply means being arranged for supplying fuel to the fuel injectors, the method comprising supplying a greater amount of fuel to one or more of the circumferentially arranged sectors than the remainder of the circumferentially arranged sectors to reduce the pressure oscillations in the combustion chamber.

Preferably the method comprises detecting the level of the pressure oscillations in the combustion chamber, determining if the pressure oscillations are above a predetermined level, supplying a greater amount of fuel to one or more of the circumferentially arranged sectors than the remainder of the circumferentially arranged sectors to reduce the pressure oscillations in the combustion chamber when the pressure oscillations are above the predetermined level or supplying equal amounts of fuel to all of the circumferentially arranged sectors to minimise emissions when the pressure oscillations are below the predetermined level.

The present invention will be more fully described by way of example with reference to the accompanying drawings, in which.

Figure 1:
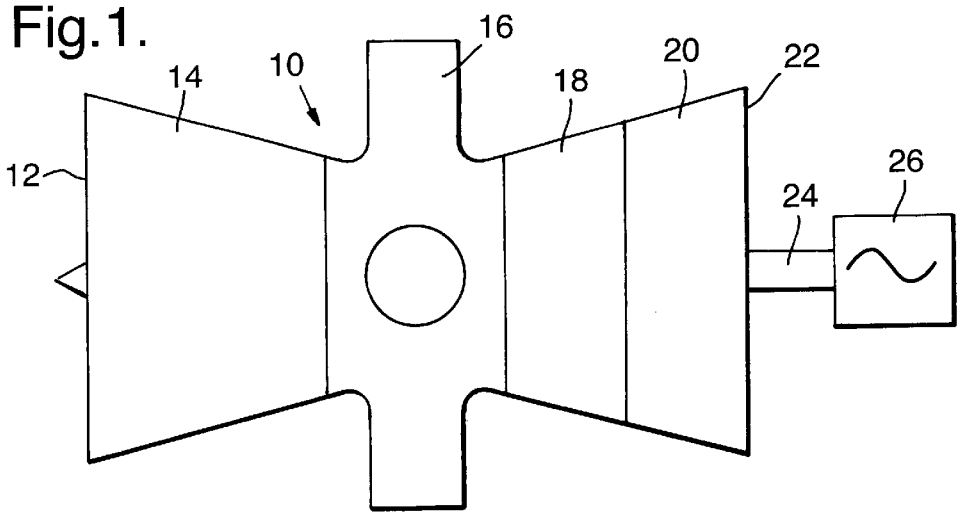
FIG. 1 is a view of a gas turbine engine having a combustion chamber according to the present invention.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 20 is arranged to drive the compressor section 14 via one or more shafts (not shown). The power turbine section 20 is arranged to drive an electrical generator 26 via a shaft 24. However, the power turbine section 20 may be arranged to provide drive for other purposes. The operation of the gas turbine engine 10 is quite conventional, and will not be discussed further.

Figure 2:
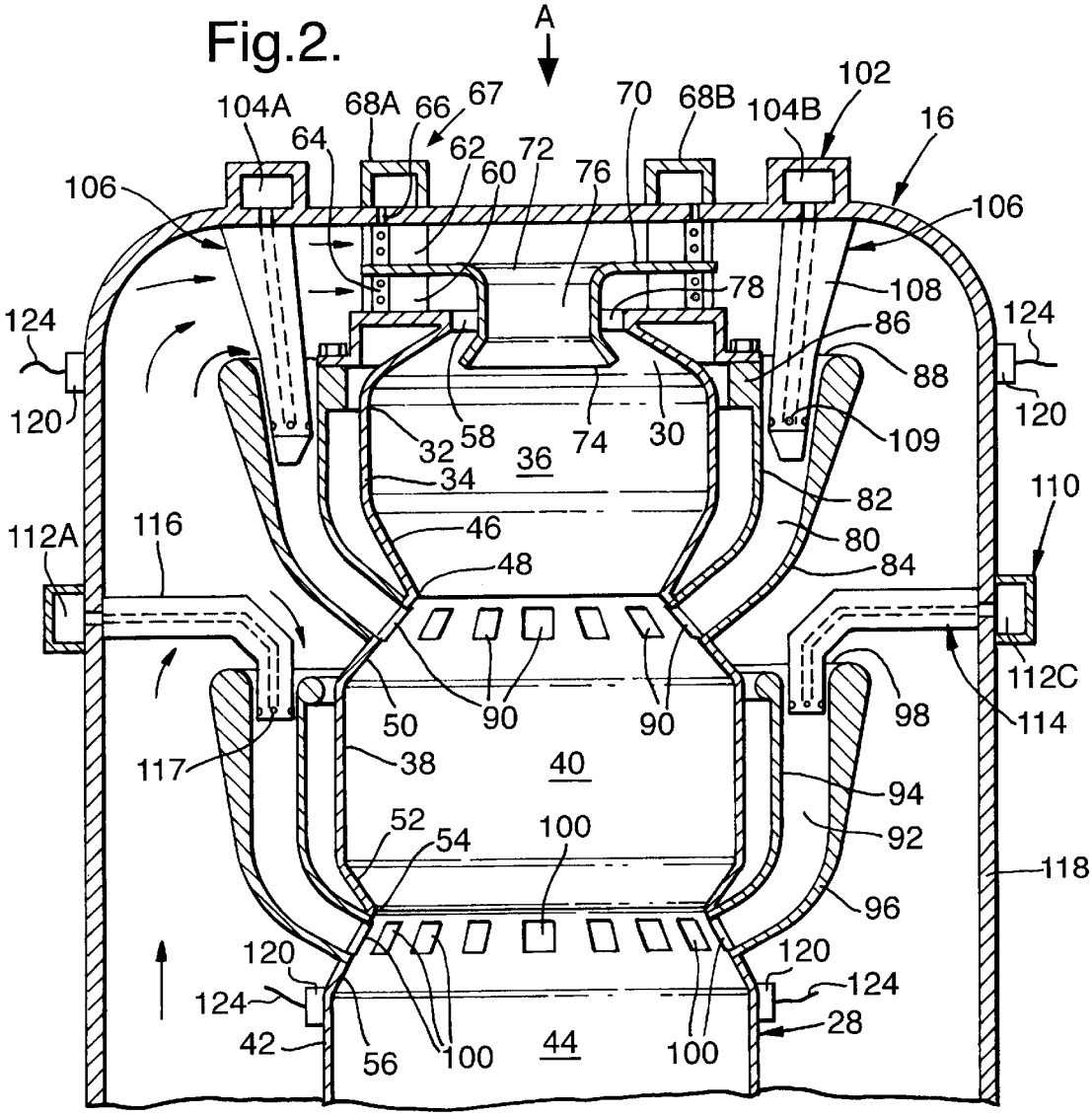
FIG. 2 is an enlarged longitudinal cross-sectional view through the combustion chamber shown in FIG. 1.
Figure 3:
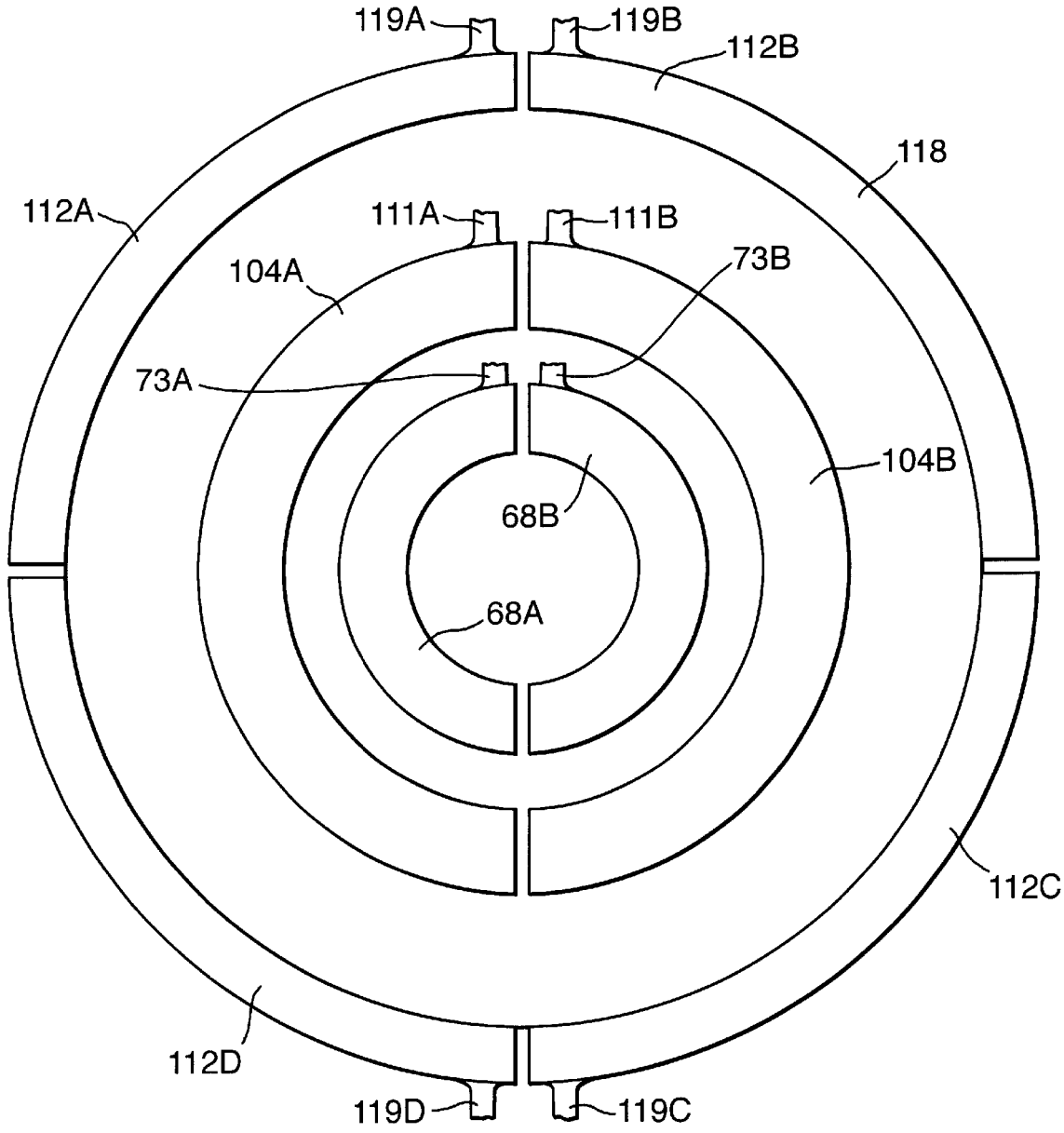
FIG. 3 is a view in the direction of Arrow A in FIG. 2 showing the primary, secondary and tertiary fuel manifolds.

The combustion chamber assembly 16 is shown more clearly in FIGS. 2 and 3. The combustion chamber assembly 16 comprises a plurality of, for example nine, equally circumferentially spaced tubular combustion chambers 28. The axes of the tubular combustion chambers 28 are arranged to extend in generally radial directions. The inlets of the tubular combustion chambers 28 are at their radially outermost ends and their outlets are at their radially innermost ends.

Each of the tubular combustion chambers 28 comprises an upstream wall 30 secured to the upstream end of an annular wall 32. A first, upstream, portion 34 of the annular wall 32 defines a primary combustion zone 36, a second, intermediate, portion 38 of the annular wall 32 defines a secondary combustion zone 40 and a third, downstream, portion 42 of the annular wall 32 defines a tertiary combustion zone 44. The second portion 38 of the annular wall 32 has a greater diameter than the first portion 34 of the annular wall 32 and similarly the third portion 42 of the annular wall 32 has a greater diameter than the second portion 38 of the annular wall 32. The downstream end of the first portion 34 has a first frustoconical portion 46 which reduces in diameter to a throat 48. A second frustoconical portion 50 interconnects the throat 48 and the upstream end of the second portion 38. The downstream end of the second portion 38 has a third frustoconical portion 52 which reduces in diameter to a throat 54. A fourth frustoconical portion 56 interconnects the throat 54 and the upstream end of the third portion 42.

A plurality of equally circumferentially spaced transition ducts are provided, and each of the transition ducts has a circular cross-section at its upstream end. The upstream end of each of the transition ducts is located coaxially with the downstream end of a corresponding one of the tubular combustion chambers 28, and each of the transition ducts connects and seals with an angular section of the nozzle guide vanes.

The upstream wall 30 of each of the tubular combustion chambers 28 has an aperture 58 to allow the supply of air and fuel into the primary combustion zone 36. A first radial flow swirler 60 is arranged coaxially with the aperture 58 and a second radial flow swirler 62 is arranged coaxially with the aperture 58 in the upstream wall 30. The first radial flow swirler 60 is positioned axially downstream, with respect to the axis of the tubular combustion chamber 28, of the second radial flow swirler 60. The first radial flow swirler 60 has a plurality of fuel injectors 64, each of which is positioned in a passage formed between two vanes of the radial flow swirler 60. The second radial flow swirler 62 has a plurality of fuel injectors 66, each of which is positioned in a passage formed between two vanes of the radial flow swirler 62. The first and second radial flow swirlers 60 and 62 are arranged such that they swirl the air in opposite directions. The first and second radial flow swirlers 60 and 62 share a common side plate 70, the side plate 70 has a central aperture 72 arranged coaxially with the aperture 58 in the upstream wall 30. The side plate 70 has a shaped annular lip 74 which extends in a downstream direction into the aperture 58. The lip 74 defines an inner primary fuel and air mixing duct 76 for the flow of the fuel and air mixture from the first radial flow swirler 60 into the primary combustion zone 36 and an outer primary fuel and air mixing duct 78 for the flow of the fuel and air mixture from the second radial flow swirler 62 into the primary combustion zone 36. The lip 74 turns the fuel and air mixture flowing from the first and second radial flow swirlers 60 and 62 from a radial direction to an axial direction. The primary fuel and air is mixed together in the passages between the vanes of the first and second radial flow swirlers 60 and 62 and in the primary fuel and air mixing ducts 76 and 78.

An annular secondary fuel and air mixing duct 80 is provided for each of the tubular combustion chambers 28. Each secondary fuel and air mixing duct 80 is arranged circumferentially around the primary combustion zone 36 of the corresponding tubular combustion chamber 28. Each of the secondary fuel and air mixing ducts 80 is defined between a second annular wall 82 and a third annular wall 84. The second annular wall 82 defines the inner extremity of the secondary fuel and air mixing duct 80 and the third annular wall 84 defines the outer extremity of the secondary fuel and air mixing duct 80. The axially upstream end 86 of the second annular wall 82 is secured to a side plate of the first radial flow swirler 60. The axially upstream ends of the second and third annular walls 82 and 84 are substantially in the same plane perpendicular to the axis of the tubular combustion chamber 28. The secondary fuel and air mixing duct 80 has a secondary air intake 88 defined radially between the upstream end of the second annular wall 82 and the upstream end of the third annular wall 84.

At the downstream end of the secondary fuel and air mixing duct 80, the second and third annular walls 82 and 84 respectively are secured to the second frustoconical portion 50 and the second frustoconical portion 50 is provided with a plurality of apertures 90. The apertures 90 are arranged to direct the fuel and air mixture into the secondary combustion zone 40 in a downstream direction towards the axis of the tubular combustion chamber 28. The apertures 90 may be circular or slots and are of equal flow area.

The secondary fuel and air mixing duct 80 reduces in cross-sectional area from the intake 88 at its upstream end to the apertures 90 at its downstream end. The shape of the secondary fuel and air mixing duct 80 produces an accelerating flow through the duct 80 without any regions where recirculating flows may occur.

An annular tertiary fuel and air mixing duct 92 is provided for each of the tubular combustion chambers 28. Each tertiary fuel and air mixing duct 92 is arranged circumferentially around the secondary combustion zone 40 of the corresponding tubular combustion chamber 28. Each of the tertiary fuel and air mixing ducts 92 is defined between a fourth annular wall 94 and a fifth annular wall 96. The fourth annular wall 94 defines the inner extremity of the tertiary fuel and air mixing duct 92 and the fifth annular wall 96 defines the outer extremity of the tertiary fuel and air mixing duct 92. The axially upstream ends of the fourth and fifth annular walls 94 and 96 are substantially in the same plane perpendicular to the axis of the tubular combustion chamber 28. The tertiary fuel and air mixing duct 92 has a tertiary air intake 98 defined radially between the upstream end of the fourth annular wall 94 and the upstream end of the fifth annular wall 96.

At the downstream end of the tertiary fuel and air mixing duct 92, the fourth and fifth annular walls 94 and 96 respectively are secured to the fourth frustoconical portion 56 and the fourth frustoconical portion 56 is provided with a plurality of apertures 100. The apertures 100 are arranged to direct the fuel and air mixture into the tertiary combustion zone 44 in a downstream direction towards the axis of the tubular combustion chamber 28. The apertures 100 may be circular or slots and are of equal flow area.

The tertiary fuel and air mixing duct 92 reduces in cross-sectional area from the intake 98 at its upstream end to the apertures 100 at its downstream end. The shape of the tertiary fuel and air mixing duct 92 produces an accelerating flow through the duct 92 without any regions where recirculating flows may occur.

Figure 4:
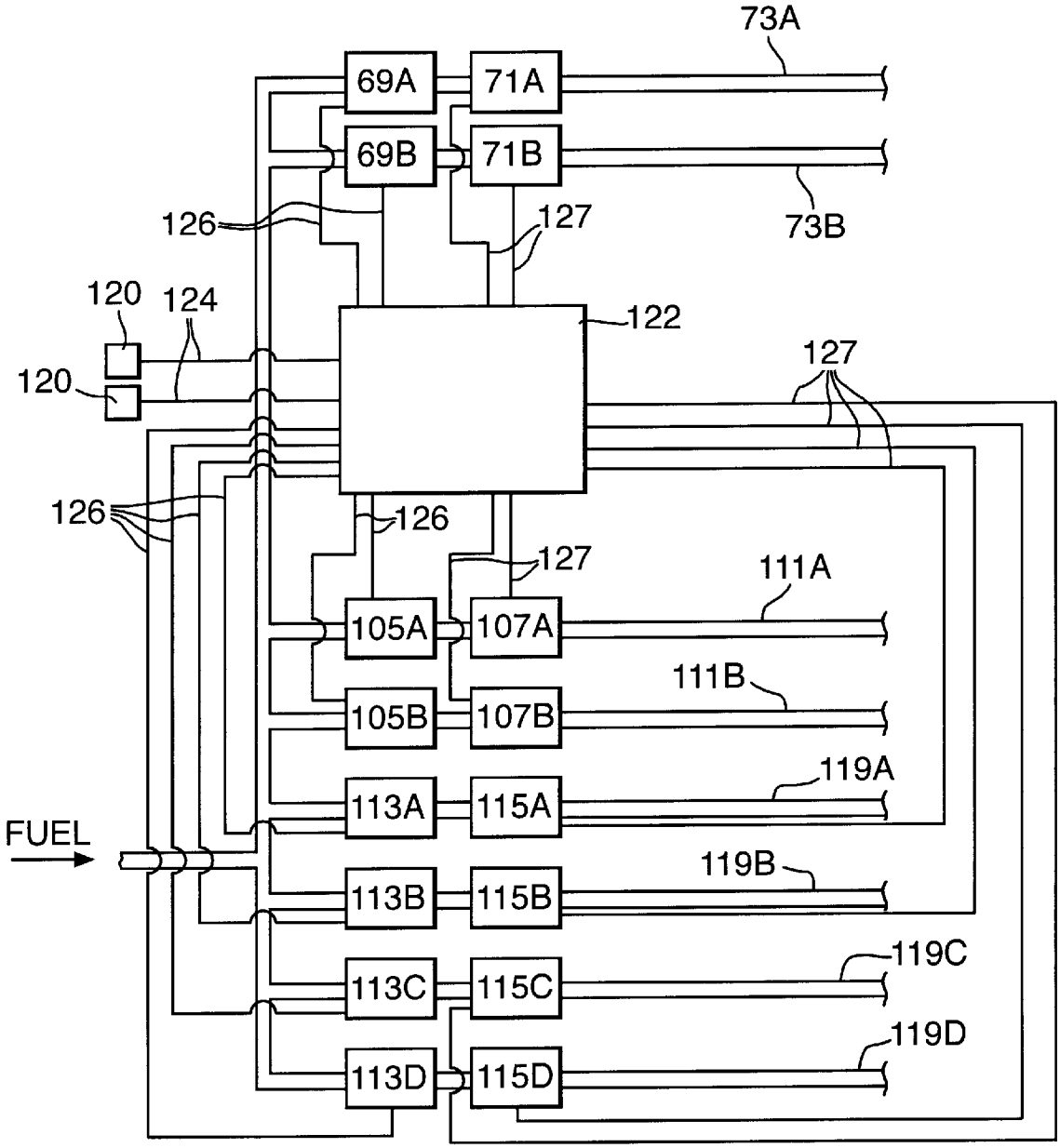
FIG. 4 is a diagrammatic view of the fuel control system for the combustion chamber shown in FIGS. 2 and 3.

A plurality of primary fuel systems 67 are provided to supply fuel to the primary fuel and air mixing ducts 76 and 78 of each of the tubular combustion chambers 28 as shown in FIGS. 2, 3 and 4. The primary fuel system 67 for each tubular combustion chamber 28 comprises a plurality of primary fuel manifolds 68A and 68B, a plurality of primary fuel valves 69A and 69B, a plurality of primary fuel measuring units 71A and 71B and a plurality of primary fuel pipes 73A and 73B. In this example there are two primary fuel manifolds 68A and 68B, two primary fuel valves 69A and 69B, two primary fuel measuring units 71A and 71B and two primary fuel pipes 73A and 73B. The primary fuel manifolds 68A and 68B are arranged at the upstream end of the tubular combustion chamber 28.

Each of the primary fuel manifolds 68A and 68B is connected to a respective one of the primary fuel valves 69A and 69B and a respective one of the primary fuel measuring units 71A and 71B via a respective one of the primary fuel pipes 73A and 73B so that the fuel is supplied independently to the two primary fuel manifolds 68A and 68B.

Each of the primary fuel manifold 68A and 68B has a plurality, for example sixteen, of equi-circumferentially spaced primary fuel injectors 64 and a plurality, for example sixteen, of equi-circumferentially spaced primary fuel injectors 66. Thus there are thirty two primary fuel injectors 64 and thirty two primary fuel injectors 66 in total. Each of the primary fuel manifolds 68A and 68B supplies fuel to a respective circumferential sector, in this example a half or a 180° sector, of the primary fuel and air mixing ducts 76 and 78 and hence of the primary combustion zone 36.

The fuel injectors 64 and 66 are supplied with fuel from the primary fuel manifolds 68A and 68B.

A plurality of secondary fuel systems 102 are provided to supply fuel to the secondary fuel and air mixing ducts 80 of each of the tubular combustion chambers 28. The secondary fuel system 102 for each tubular combustion chamber 28 comprises a plurality of secondary fuel manifolds 104A and 104B, a plurality of secondary fuel valves 105A and 105B, a plurality of secondary fuel measuring units 107A and 107B and a plurality of secondary fuel pipes 111A and 111B. In this example there are two secondary fuel manifolds 104A and 104B, two secondary fuel valves 105A and 105B, two secondary fuel measuring units 107A and 107B and two secondary fuel pipes 111A and 111B. The secondary fuel manifolds 104A and 104B are arranged around the tubular combustion chamber 28 at the upstream end of the tubular combustion chamber 28.

Each of the secondary fuel manifolds 104A and 104B is connected to a respective one of the secondary fuel valves 105A and 105B and a respective one of the secondary fuel measuring units 107A and 107B via a respective one of the secondary fuel pipes 111A and 111B so that the fuel is supplied independently to the two secondary fuel manifolds 104A and 104B.

Each of the secondary fuel manifold 104A and 104B has a plurality, for example sixteen, of equi-circumferentially spaced secondary fuel injectors 106. Thus there are thirty two secondary fuel injectors 106 in total. Each of the secondary fuel manifolds 104A and 104B supplies fuel to a respective circumferential sector, in this example a half or a 180° sector, of the secondary fuel and air mixing duct 80 and hence of the secondary combustion zone 40.

Each of the secondary fuel injectors 106 comprises a hollow member 108 which extends axially with respect to the tubular combustion chamber 28, from the secondary fuel manifold 104 in a downstream direction through the intake 88 of the secondary fuel and air mixing duct 80 and into the secondary fuel and air mixing duct 80. Each hollow member 108 extends in a downstream direction along the secondary fuel and air mixing duct 80 to a position, sufficiently far from the intake 88, where there are no recirculating flows in the secondary fuel and air mixing duct 80 due to the flow of air into the duct 80. The hollow members 108 have a plurality of apertures 109 to direct fuel circumferentially towards the adjacent hollow members 108. The secondary fuel and air mixing duct 80 and secondary fuel injectors 106 are discussed more fully in our European patent application EP0687864A.

A plurality of tertiary fuel systems 110 are provided, to supply fuel to the tertiary fuel and air mixing ducts 92 of each of the tubular combustion chambers 28. The tertiary fuel system 110 for each tubular combustion chamber 28 comprises a plurality of tertiary fuel manifolds 112A, 112B, 112C and 112D, a plurality of tertiary fuel valves 113A, 113B, 113C and 113D, a plurality of tertiary fuel measuring units 115A, 115B, 115C and 115D and a plurality of tertiary fuel pipes 119A, 119B, 119C and 119D. In this example there are four tertiary fuel manifolds 112A, 112B, 112C and 112D, four tertiary fuel valves 113A, 113B, 113C and 113D, four tertiary fuel measuring units 115A, 115B, 115C and 115D and four tertiary fuel pipes 119A, 119B, 119C and 119D. The tertiary fuel manifolds 112A, 112B, 112C and 112D are arranged around the tubular combustion chamber 28 but may be positioned inside the casing 118.

Each of the tertiary fuel manifolds 112A, 112B, 112C and 112D is connected to a respective one of the tertiary fuel valves 113A, 113B, 113C and 113D and a respective one of the tertiary fuel measuring units 115A, 115B, 115C and 115D via a respective one of the tertiary fuel pipes 119A, 119B, 119C and 119D so that the fuel is supplied independently to the four tertiary fuel manifolds 112A, 112B, 112C and 112D.

Each tertiary fuel manifold 112A, 112B, 112C and 112D has a plurality, for example eight, of equi-circumferentially spaced tertiary fuel injectors 114. Thus there are thirty two tertiary fuel injectors 114 in total.

Each of the tertiary fuel manifolds 112A, 112B, 112C and 112D supplies fuel to a respective circumferential sector, in this example a quarter or a 90° sector, of the tertiary fuel and air mixing duct 92 and hence of the tertiary combustion zone 44.

Each of the tertiary fuel injectors 114 comprises a hollow member 116 which extends initially radially and then axially with respect to the tubular combustion chamber 28, from the tertiary fuel manifold 112 in a downstream direction through the intake 98 of the tertiary fuel and air mixing duct 92 and into the tertiary fuel and air mixing duct 92. Each hollow member 116 extends in a downstream direction along the tertiary fuel and air mixing duct 92 to a position, sufficiently far from the intake 98, where there are no recirculating flows in the tertiary fuel and air mixing duct 92 due to the flow of air into the duct 92. The hollow members 116 have a plurality of apertures 117 to direct fuel circumferentially towards the adjacent hollow members 117.

One or more transducers 120 are acoustically coupled to the combustion chambers 28 to detect pressure oscillations in the combustion chamber 28. The transducers 120 are connected to a controller 122 via electrical leads 124 to allow electrical signals corresponding to the level, or amplitude, of the pressure oscillations to be transmitted to the controller 122.

The controller 122 is connected to each of the primary fuel valves 69A and 69B, secondary fuel valves 105A and 105B and tertiary fuel valves 113A, 113B, 113C and 113D by electrical connectors 126. The controller 122 is electrically connected to each of the primary fuel measuring units 71A and 71B, secondary fuel measuring units 107A and 107B and tertiary fuel measuring units 115A, 115B, 115C and 115D via electrical leads 127.

The controller 122 analyses the electrical signal supplied by the transducer 120 to determine if the pressure oscillations are above a predetermined level, or amplitude. The controller 122 also analyses the electrical signals, indicating the quantity of fuel, supplied by the primary fuel measuring units 71A and 71B, secondary fuel measuring units 107A and 107B and the tertiary fuel measuring units 115A, 115B, 115C and 115D.

As discussed previously the fuel and air supplied to the combustion zones 36, 40 and 44 is premixed and each of the combustion zones 36, 40 and 44 is arranged to provide lean combustion to minimise NOx. The products of combustion from the primary combustion zone 36 flow through the throat 48 into the secondary combustion zone 40 and the products of combustion from the secondary combustion zone 40 flow through the throat 54 into the tertiary combustion zone 44. Due to pressure fluctuations in the air flow into the tubular combustion chambers 28, the combustion process amplifies the pressure fluctuations for the reasons discussed previously and may cause components of the gas turbine engine 10 to become damaged if they have a natural frequency of a vibration mode coinciding with the frequency of the pressure fluctuations.

In operation the transducers 120 detect the pressure oscillations in the combustion chambers 28 and send electrical signals to the controller 122. The controller 122 determines if the pressure oscillations are above the predetermined amplitude.

If the controller 122 determines that the pressure oscillations are below the predetermined amplitude the controller 122 sends signals to both of the primary fuel valves 69A and 69B so that equal amounts of fuel are supplied from the two primary fuel manifolds 68A and 68B into the two halves of the primary fuel and air mixing ducts 76 and 78 and hence the primary combustion zone 36.

Similarly the controller 122 sends signals to both of the secondary fuel valves 105A and 105B so that equal amounts of fuel are supplied from the two secondary fuel manifolds 104A and 104B into the two halves of the secondary fuel and air mixing duct 80 and hence the secondary combustion zone 40.

Additionally the controller 122 sends signals to all four of the tertiary fuel valves 113A, 113B, 113C and 113D so that equal amounts of fuel are supplied from the four tertiary fuel manifolds 112A, 112B, 112C and 112D into the four quarters of the tertiary fuel and air mixing duct 92 and hence the tertiary combustion zone 44.

This ensures that low emissions of nitrous oxides and carbon monoxide are achieved when the pressure oscillations are within acceptable limits.

If the controller 122 determines that the pressure oscillations are above the predetermined amplitude the controller 122 sends signals to both of the primary fuel valves 69A and 69B so that a greater amount of fuel is supplied from the primary fuel manifold 64A than the primary fuel manifold 68B into the two halves of the primary fuel and air mixing ducts 76 and 78 and hence the primary combustion zone 36. This causes one half of the primary combustion zone 36 to be operating at a higher temperature than the temperature of the other half of the primary combustion zone 36 and also higher than the average temperature of the primary combustion zone 36. The two halves of the primary combustion zone 36 are then operating at a different temperature to the average temperature of the primary combustion zone 36 and therefore the pressure oscillations are reduced, preferably minimised.

Alternatively if the controller 122 determines that the pressure oscillations are above the predetermined amplitude the controller 122 sends signals to both of the secondary fuel valves 105A and 105B so that a greater amount of fuel is supplied from the secondary fuel manifolds 104A than the secondary fuel manifold 104B into the two halves of the secondary fuel and air mixing duct 80 and hence the secondary combustion zone 40. This causes one half of the secondary combustion zone 40 to be operating at a higher temperature than the temperature of the other half of the secondary combustion zone 40 and also higher than the average temperature of the secondary combustion zone 40. The two halves of the secondary combustion zone 40 are then operating at a different temperature to the average temperature of the secondary combustion zone 40 and therefore the pressure oscillations are reduced, preferably minimised.

Alternatively the controller 122 sends signals to all four of the tertiary fuel valves 113A, 113B, 113C and 113D so that a greater amount of fuel is supplied from the tertiary fuel manifold 112A than the tertiary fuel manifolds 112B, 112C and 112D into the four quarters of the tertiary fuel and air mixing duct 92 and hence the tertiary combustion zone 44. This causes one quarter of the tertiary combustion zone 44 to be operating at a higher temperature than the temperature of the other three quarters of the tertiary combustion zone 44 and also higher than the average temperature of the tertiary combustion zone 44. The four quarters of the tertiary combustion zone 44 are then operating at a different temperature to the average temperature of the tertiary combustion zone 44 and therefore the pressure oscillations are reduced, preferably minimised. A further alternative is to supply a greater amount of fuel to three quarters of the tertiary combustion zone 44 than the other quarter. An additional alternative is to supply a greater amount of fuel to two adjacent or two diametrically opposite quarters than the other two quarters.

A further alternative is to supply more fuel to one of the primary fuel manifolds 68A than the other primary fuel manifold 68B and to supply more fuel to one of the secondary fuel manifolds 104A than the other secondary fuel manifolds 104B.

A further alternative is to supply more fuel to one of the secondary fuel manifolds 104A than the other secondary fuel manifold 104B and to supply more fuel to one of the tertiary fuel manifolds 112A than the other tertiary fuel manifolds 112B, 112C and 112D.

A further alternative is to supply more fuel to one of the primary fuel manifolds 68A than the other primary fuel manifold 68B and to supply more fuel to one of the tertiary fuel manifolds 112A than the other tertiary fuel manifolds 112B, 112C and 112D.

A further alternative is to supply more fuel to one of the primary fuel manifolds 68A than the other primary fuel manifold 68B, to supply more fuel to one of the secondary fuel manifolds 104A than the other secondary fuel manifolds 104B and to supply more fuel to one of the tertiary fuel manifolds 112A than the other tertiary fuel manifolds 112B, 112C and 112D.

Figure 5:
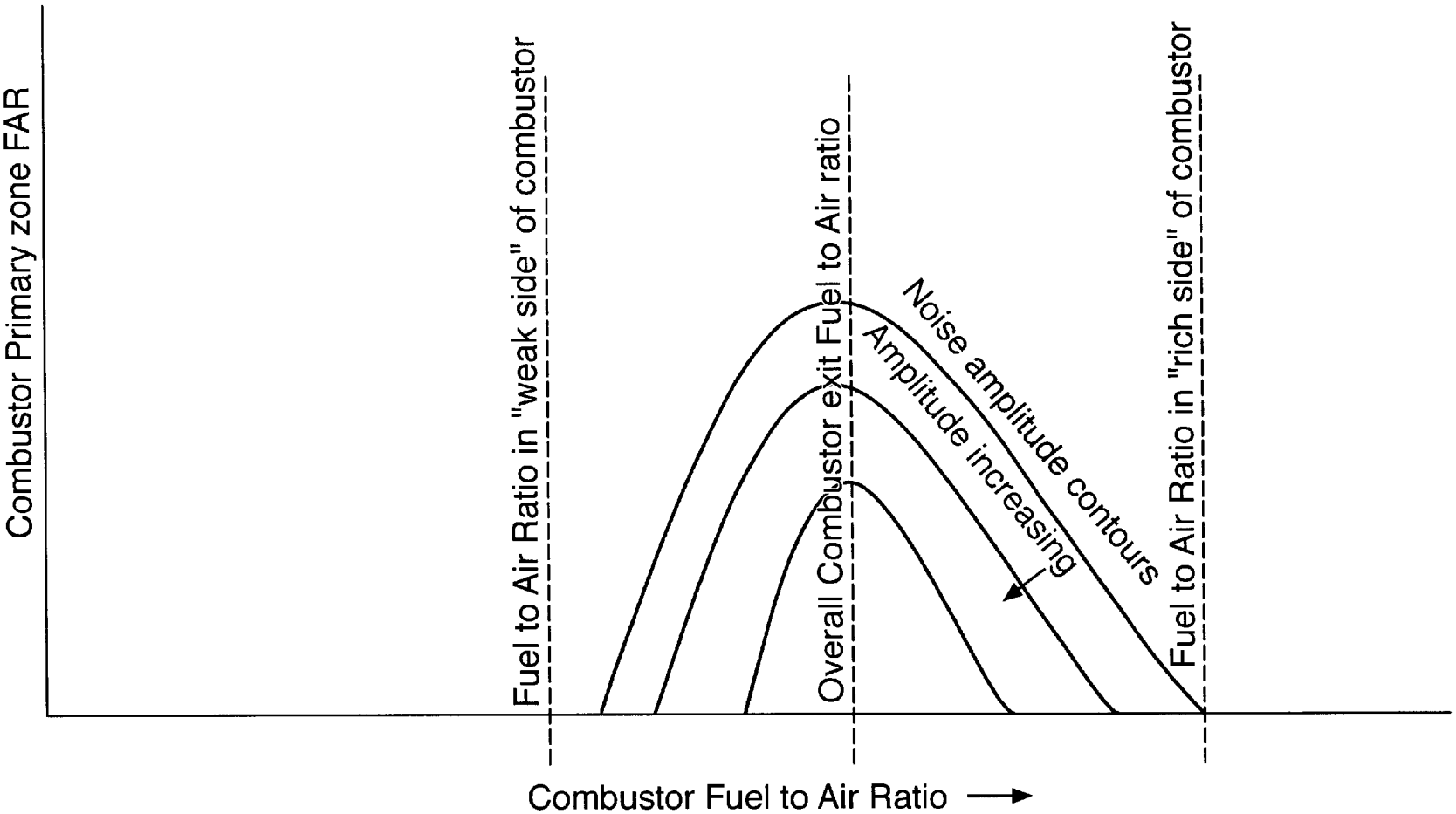
FIG. 5 is a graph showing the primary combustion zone fuel to air ratio against combustor fuel to air ratio with noise amplitude contours.

The effect of the invention is explained with reference to FIG. 5. The destructive pressure oscillations occur when the fuel to air ratio at all parts of a combustion zone, and hence the temperature at all parts of the combustion zone, are equal to the average fuel to air ratio or equal to the average temperature.

The invention supplies a greater amount of fuel to one half of the primary combustion zone 36 than the other half of the primary combustion zone 36 such that one half of the primary combustion zone 36 is operating with a fuel to air ratio less than the average fuel to air ratio and one half of the primary combustion zone 36 is operating with a fuel to air ratio greater than the average fuel to air ratio. The invention changes the fuel to air ratio, and hence the temperature, in different sectors of the primary combustion zone so that the pressure oscillations are reduced.

A predetermined amount of fuel is supplied to the primary combustion zone 36 by the primary fuel injectors 64 and 66. The controller 122 adjusts the supply of fuel so that a greater proportion of the fuel is supplied by the primary fuel manifold 68A and the primary fuel injectors 64 and 66 at one half of the primary combustion zone 36 and a lesser proportion of fuel is supplied by the primary fuel manifold 68B and the primary fuel injectors 64 and 66 at the other half of the primary combustion zone 36 in order to reduce the pressure oscillations.

If the controller 122 determines that there are still pressure oscillations above the predetermined amplitude, the controller 122 further increases the proportion of fuel supplied by the primary fuel manifold 68A and primary fuel injectors 64 and 66 and further decreases the proportion of fuel supplied by the primary fuel manifold 68B and the fuel injectors 64 and 66 into the primary combustion zone 36.

If the controller 122 determines that the pressure oscillations are below the predetermined amplitude, the controller 122 decreases the proportion of fuel supplied by the primary fuel manifold 68A and primary fuel injectors 64 and 66 and increases the proportion of fuel supplied by the primary fuel manifold 68B and the fuel injectors 64 and 66 into the primary combustion zone 36. The controller 122 decreases the proportion of fuel supplied by the primary fuel manifold 68A and primary fuel injectors 64 and 66 and increases the proportion of fuel supplied by the primary fuel manifold 68B and the fuel injectors 64 and 66 into the primary combustion zone 36 while the pressure oscillations remain below the predetermined level or until equal amounts of fuel are supplied from both of the primary fuel manifolds 68A and 68B.

A predetermined amount of fuel is supplied to the secondary combustion zone 40 by the secondary fuel injectors 106. The controller 122 adjusts the supply of fuel so that a greater proportion of the fuel is supplied by the secondary fuel manifold 104A and the secondary fuel injectors 106 at one half of the secondary combustion zone 40 and a lesser proportion of fuel is supplied by the secondary fuel manifold 104B and the secondary fuel injectors 106 at the other half of the secondary combustion zone 40 in order to reduce the pressure oscillations.

If the controller 122 determines that there are still pressure oscillations above the predetermined amplitude, the controller 122 further increases the proportion of fuel supplied by the secondary fuel manifold 104A and secondary fuel injectors 106 and further decreases the proportion of fuel supplied by the secondary fuel manifold 104B and the fuel injectors 106 into the secondary combustion zone 40.

If the controller 122 determines that the pressure oscillations are below the predetermined amplitude, the controller 122 decreases the proportion of fuel supplied by the secondary fuel manifold 104A and secondary fuel injectors 106 and increases the proportion of fuel supplied by the secondary fuel manifold 104B and the fuel injectors 106 into the secondary combustion zone 40. The controller 122 decreases the proportion of fuel supplied by the secondary fuel manifold 104A and secondary fuel injectors 106 and increases the proportion of fuel supplied by the secondary fuel manifold 104B and the fuel injectors 106 into the secondary combustion zone 40 while the pressure oscillations remain below the predetermined level or until equal amounts of fuel are supplied from both of the secondary fuel manifolds 104A and 104B.

A predetermined amount of fuel is supplied to the tertiary combustion zone 44 by the tertiary fuel injectors 114. A similar process occurs to the supply of fuel by the tertiary fuel manifolds 112A, 112B, 112C and 112D.

Thus the invention allows a combustion chamber to operated at a mean fuel to air ratio, at a predetermined operating power level, which would normally generate pressure oscillations with substantially reduced amplitude of the pressure oscillations.

This enables the combustion chamber to be operated to achieve a wider range of engine power levels and emissions performance, without producing pressure oscillation levels which will damage the combustion chamber or gas turbine engine. Thus the invention circumferentially biases the fuel in one or more combustion zones. The circumferential biasing of the fuel may be to increase the proportion of fuel at one or more circumferential sectors relative to the remaining circumferential sectors.

Although the invention has been described with reference to fuel manifolds supplying fuel to two or four circumferential sectors any other suitable number of sectors may be used, for example three, six, eight ten etc. The circumferential sectors may or may not be equal in angular extent.

The invention is applicable to combustion chambers for other apparatus with combustion stages arranged in flow series.

The combustion chamber may be annular or can-annular. The fuel may be gas or liquid fuel.

I claim:

1. A combustion chamber comprising a plurality of combustion zones arranged in flow series defined by at least one peripheral wall, each combustion zone having at least one fuel and air mixing duct for supplying fuel and air into the respective one of the combustion zones, each of the fuel and air mixing ducts having at least one fuel injector for supplying fuel into the respective one of the fuel and air mixing ducts, the fuel injectors in the at least one fuel and air mixing duct for at least two of the combustion zones being arranged into a plurality of circumferentially arranged sectors, fuel supply means being arranged for supplying fuel to the fuel injectors, the fuel supply means being arranged for supplying a greater amount of fuel to one or more of the circumferentially arranged sectors than the remainder of the circumferentially arranged sectors to reduce the pressure oscillations in the combustion chamber.

2. A combustion chamber as claimed in claim 1 wherein the combustion chamber comprises a primary combustion zone and a secondary combustion zone downstream of the primary combustion zone.

3. A combustion chamber as claimed in claim 2 wherein the combustion chamber comprises a primary combustion zone, a secondary combustion zone downstream of the primary combustion zone and a tertiary combustion zone downstream of the secondary combustion zone.

4. A combustion chamber as claimed in claim 3 wherein the fuel injectors in the fuel and air mixing duct supplying fuel and air into the tertiary combustion zone are arranged in circumferentially arranged sectors.

5. A combustion chamber as claimed in claim 2 wherein the fuel injectors in the fuel and air mixing duct supplying fuel and air into the secondary combustion zone are arranged in circumferentially arranged sectors.

6. A combustion chamber as claimed in claim 2 wherein the fuel injectors in the fuel and air mixing duct supplying fuel and air into the primary combustion zone arranged in circumferentially arranged sectors.

7. A combustion chamber as claimed in claim 1 wherein the at least one fuel and air mixing duct comprises a plurality of fuel and air mixing ducts.

8. A combustion chamber as claimed in claim 1 wherein there are two circumferentially arranged sectors for a zone.

9. A combustion chamber as claimed in claim 8 wherein the two circumferentially arranged sectors are halves or extend over 180°.

10. A combustion chamber as claimed in claim 1 wherein there are three circumferentially arranged sectors for a zone.

11. A combustion chamber as claimed in claim 10 wherein the three circumferentially arranged sectors are thirds or extend over 120°.

12. A combustion chamber as claimed in claim 1 wherein there are four circumferentially arranged sectors.

13. A combustion chamber as claimed in claim 12 wherein the four circumferentially arranged sectors are quarters or extend over 90°.

14. A combustion chamber as claimed in claim 1 wherein there are six circumferentially arranged sectors.

15. A combustion chamber as claimed in claim 14 wherein the six circumferentially arranged sectors are sixths or extend over 60°.

16. A combustion chamber as claimed in claim 1 wherein there are eight circumferentially arranged sectors.

17. A combustion chamber as claimed in claim 16 wherein the eight circumferentially arranged sectors are eighths or extend over 45°.

18. A combustion chamber as claimed in claim 1 wherein the at least one fuel and air mixing duct comprises a single annular fuel and air mixing duct.

19. A combustion chamber as claimed in claim 1 wherein the fuel supply means comprises a plurality of fuel manifolds and a plurality of fuel valves, each fuel manifold supplying fuel to the fuel injectors in a respective of the circumferentially arranged sectors, each fuel valve controlling the supply of fuel to a respective one of the fuel manifolds.

20. A combustion chamber as claimed in claim 1 wherein transducer means are acoustically coupled to the combustion chamber to detect pressure oscillations in the combustion chamber.

21. A combustion chamber as claimed in claim 20 wherein the transducer means are arranged to send a signal indicative of the level of the pressure oscillations in the combustion chamber to a controller, the controller being arranged to send signals to the fuel valves for supplying a greater amount of fuel to one or more of the circumferentially arranged sectors than the remainder of the circumferentially arranged sectors to reduce the pressure oscillations in the combustion chamber when the pressure oscillations are above a predetermined level and for supplying equal amounts of fuel to all of the circumferentially arranged sectors to minimise emissions when the pressure oscillations are below the predetermined level.

22. A gas turbine engine comprising a combustion chamber as claimed in claim 1.

23. A method of operating a combustion chamber comprising a plurality of combustion zones arranged in flow series defined by at least one peripheral wall, each combustion zone having at least one fuel and air mixing duct for supplying fuel and air into the respective one of the combustion zones, each of the fuel and air mixing ducts having at least one fuel injector for supplying fuel into the respective one of the fuel and air mixing ducts, the fuel injectors in the at least one fuel and air mixing duct for at least two of the combustion zones being arranged into a plurality of circumferentially arranged sectors, fuel supply means being arranged for supplying fuel to the fuel injectors, the method comprising supplying a greater amount of fuel to one or more of the circumferentially arranged sectors than the remainder of the circumferentially arranged sectors to reduce the pressure oscillations in the combustion chamber.

24. A method as claimed in claim 23 comprising detecting the level of the pressure oscillations in the combustion chamber, determining if the pressure oscillations are above a predetermined level, supplying a greater amount of fuel to one or more of the circumferentially arranged sectors than the remainder of the circumferentially arranged sectors to reduce the pressure oscillations in the combustion chamber when the pressure oscillations are above the predetermined level or supplying equal amounts of fuel to all of the circumferentially arranged sectors to minimise emissions when the pressure oscillations are below the predetermined level.

* * * * *